United States Patent [19]

Wanser

[11] 4,092,485

[45] May 30, 1978

[54] GAS INSULATED ELECTRICAL HIGH OR VERY HIGH VOLTAGE CABLE

[75] Inventor: Gerhard A. H. Wanser, Langenhagen, Germany

[73] Assignee: Gould, Inc., Rolling Meadows, Ill.

[21] Appl. No.: 738,007

[22] Filed: Nov. 2, 1976

[30] Foreign Application Priority Data

Nov. 3, 1975 Germany ..... 2548974

[51] Int. Cl.[2] ..... H01B 1/02; H01B 9/04

[52] U.S. Cl. ..... 174/28; 174/DIG. 7; 174/102 D

[58] Field of Search ..... 174/28, 29, DIG. 7, 174/16 B, 102 D

[56] References Cited

U.S. PATENT DOCUMENTS 3,333,037 7/1967 Humphrey et al. ..... 174/DIG. 7
3,333,049 7/1967 Humphrey et al. ..... 174/DIG. 7
3,333,050 7/1967 Humphrey et al. ..... 174/DIG. 7

FOREIGN PATENT DOCUMENTS 1,412,512 8/1965 France ..... 174/DIG. 7

OTHER PUBLICATIONS

*Sodium Conductors for Power Distribution,* Electrical Construction & Maintenance, vol. 68, No. 12, 12–69, pp. 76–78 & 97.

*Primary Examiner*—Arthur T. Grimley
*Attorney, Agent, or Firm*—Ralf H. Siegemund

[57] ABSTRACT

The inner conductor of a gas filled high voltage cable is of composite construction in that a core of alkali-metal, an alloy thereof or two or more alkali-metals, are arranged in a thermoplastic or elastomeric cover which, in turn, is contained in a corrugated metal tube. The outer conductor and spacers are conventional.

7 Claims, 2 Drawing Figures

GAS INSULATED ELECTRICAL HIGH OR VERY HIGH VOLTAGE CABLE

BACKGROUND OF THE INVENTION

The present invention relates to a gas insulated high or ultrahigh voltage cable for transmitting heavy currents, and being comprised of an inner conductor for conducting the current and an outer, tubular metal jacket held coaxially to the inner conductor in spaced-apart relationship thereto.

Transporting large quantities of electrical energy, particularly in densely populated areas, pose difficulties to an increasing extent in that the heretofore used cable and conductors are no longer sufficient. In addition to the currently developed cryogenic cable, a recent development has lead to the use of so-called gas insulated electrical cable. These cable are comprised essentially of an inner conductor for conducting the current, a spacer construction, and an outer tubular metal jacket, whereby the space between inner tube and outer tube is filled, e.g., with an $SF_6$ gas.

Two systems have been suggested for actual use in practice; one system is characterized by the use of rigid inner and outer conductors in tubular configuration, which the other system provides for the use of flexible metallic construction parts. Rigid tube systems require that a length of a cable be installed at a construction site through interconnection of relatively short individual lengths. On the other hand, flexible systems can be handled just like the usual cables i.e., following manufacturing they are reeled on cable drums and unreeled therefrom during installation.

Both systems pose difficulties due to the relatively large diameter of the inner conductor. Such a large diameter is required for the conduction of heavy currents. Large cross-sections here lead to correspondng large cross-sections of the copper which, in turn, leads to a large weight and high stiffness of the inner conductor. Aside from the reduced degree of bendability, the spacer construction is detrimentally affected by that large weight.

DESCRIPTION OF THE INVENTION

It is an object of the present invention to provide a device which can be made at great lengths and has at least similar properties as regards to the conduction of currents, and is still of simple construction as well as improved in regard to installation.

The object of the invention as it relates to gas insulated, electrical high or ultrahigh voltage cable of the type outlined above, is achieved as per the invention in that the inner conductor is comprised of a core of alkali metal, an alloy or of two or more alkali metals inside of an adjoining protective cover made of a thermoplastic or elastomeric material, and a metal envelope enclosing the cover, and being comprised of a corrugated metal tube. For at least similar properties of conducting current, the weight of the inner conductor can be reduced considerably so that the spacing elements can be simplified considerably in their mechanical configuration as compared with prior embodiments. Also, the dimensions of such spacing elements can be reduced to a considerable extent. Difficulties, damage or even destruction will no longer arise during reeling in the flexible design having an outer corrugated tubular jacket and under the higher load conditions for the spacer during such reeling.

The corrugated tube offers additional protection for the inner, alkali-metal core due to the high arch stiffness of that tube. Thermal expansions under load are taken up to a sufficient degree by the insulating protecting cover. Additional expanding forces in radial or axial direction, being possible under extreme conditions, are compensated by the corrugated metal tube.

Electrical conductors made of alkali-metal are known per se (German printed patent application No. 1,490,837). This reference discloses also a method for making such a conductor in that a protective cover of thermoplastic material is extruded onto the alkali-metal core. A metal ribbon is provided here as an outer shield for high voltages. The metal ribbon is made of copper or aluminum and is connected at the edges through flanging, soldering or the like. Aside from the fact that this configuration is not suitable for the transport of high or very high currents due to relatively small expansion, the closed shield is capable of undergoing the mechanical stability of such a conductor is insufficient for its use as inner conductor in a gas insulated high voltage cable. For the inner conductor of a gas insulated cable does not only have the electrical function of current transmission, but also the mechanical function of retaining the outer tube in a concentric position through spacer elements.

For making an inner conductor, constructed in accordance with the invention for use in a gas insulated high and ultrahigh voltage cable, it has been found particularly advantageous for practicing the invention, if the corrugated metal tube is comprised of a metal strip which was longitudinally paid, formed into a tube, welded along the edges and subsequently corrugated, the metal strip being preferably made of copper. Such a metal tube permits continuous production of the inner conductor in that the alkali-metal core is enveloped in a protective cover of thermoplastic or elastomeric material in one and the same working step in which after subsequent cooling of the protective cover the thus prepared stock is being enclosed in the metallic envelope. This envelope is gas-tightly welded and will be corrugated subsequently which completes the making of an extremely flexible inner conductor for such a cable and which can be manufactured continously.

In furtherance of the invention, the protective cover fits snugly on the alkali-metal core, which features can be obtained without difficulties during extrusion of the cover. The metal envelope around the protective cover sits only loosely thereon. This feature has the advantage that the inner core is freely movable in the metal envelope, so that even extreme expansions can be taken up. The metal envelope prevents also access of oxygen and moisture, even during long use of the cable.

In some instances it can be of advantage to fill the space between protective cover and the envelope with an inert protective gas. This gas can thereby be used for protecting the inner core, possibly also for monitoring the tightness of the metal envelope.

It can also be advantageous in cases to provide the protective cover with additives which increase the thermal conductivity and/or the electrical conductivity. Thus, carbon black, metal particles etc. may be added to the elastomeric or thermoplastic material for improving thermal conductivity and electrical conductivity. Also, it may be of advantage to provide a conductive layer as outer shield on the basically insulating outer protective cover. The corrugation valleys of the metal envelope as arranged thereon will be seated on this shielding layer.

DESCRIPTION OF THE DRAWINGS

The invention will be explained more fully with reference to the drawings, in which

The core 1 of the inner conductor is comprised of an alkali-metal, e.g. sodium. The core 1 is enveloped by the protective cover 2 which sits tightly on core 1 and is comprised of a thermoplastic material, e.g. polyethylene. As shown in FIG. 2, cover 2 may carry a metal shield 2*a*. in either case, a metal envelope 3 is mounted on the cover and serves as moisture-proof protection for preventing penetration of oxygen. The envelope 3 has the configuration of a corrugated tube. The corrugations are shown to be closed loops, however, they may run helically. A helical corrugation has particular advantages if the space between envelope 3 and cover 2 is to be used as flow space of an inert gas. The metallic envelope is sufficiently mechanically stabile so that it can be used also as support for spacers 4. In the illustrated example, spacers 4 are comprised of support elements 5, arranged around the circumference of envelope 3, and metal rings 6 hold the support elements 4. In the alternative, one could use with advantage disc-shaped spacers in the illustrated construction. A likewise corrugated outer tubular jacket 7 serves as outer metal jacket which is covered by an outer protective jacket 8 made of thermoplastic material.

Figures 1, 2:
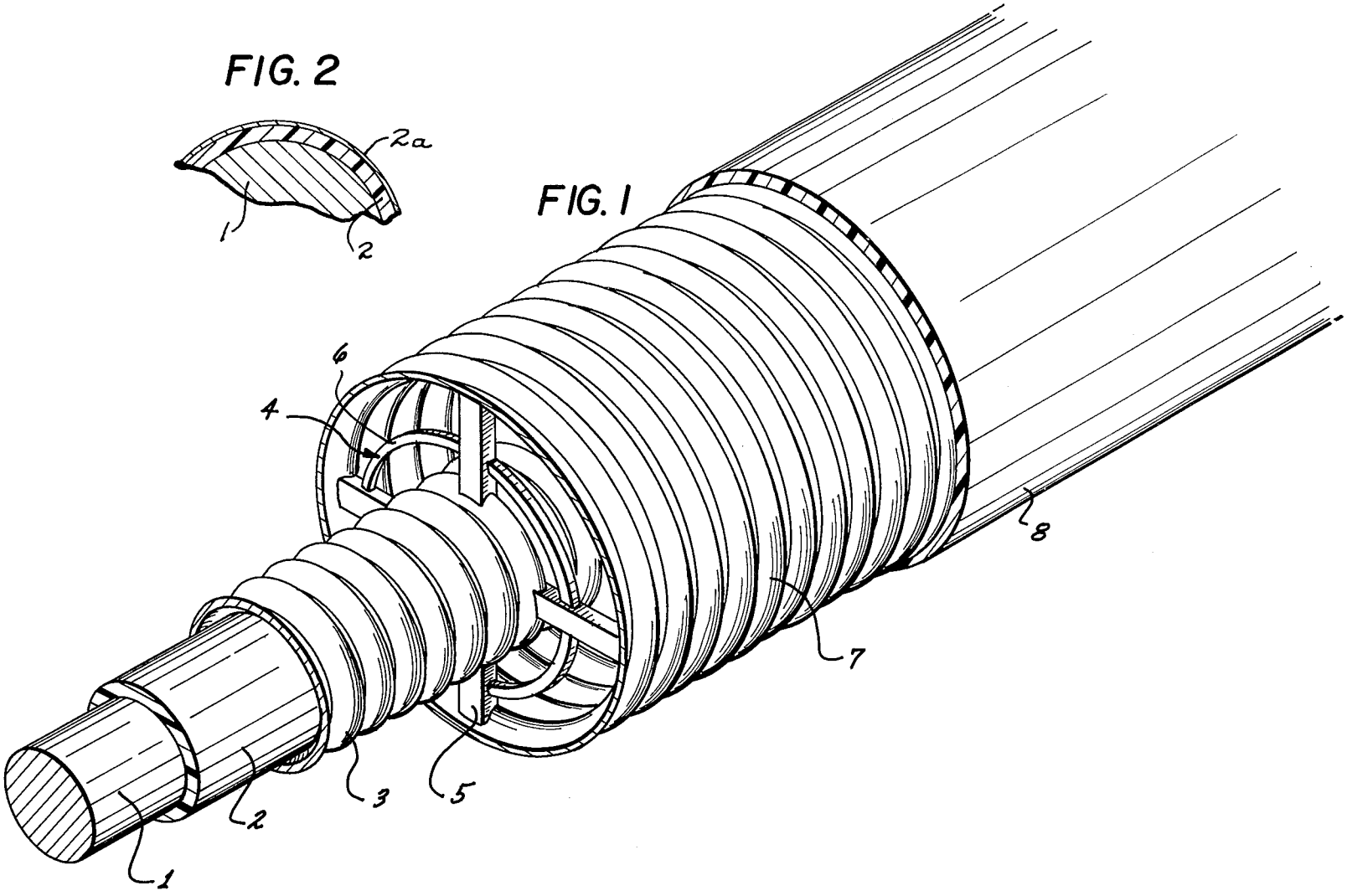
FIG. 1 is a perspective view into a gas insulated high voltage cable and FIG. 2 is a modified detail.

Deviating from this flexible embodiment of a gas insulated cable which can be made in great lengths, reeled on drums, and reeled therefrom for installation, it is, of course, also possible to construct the outer tube in a rigid configuration which is delivered to the installation site in short lengths and assembled thereat. The inner conductor is then inserted into that tube system. Still another possibility exists, particularly when extreme high voltages are to be conducted, in that the outer tube is provided in form of two shells, having suitable length for installation, and they are joined above the inner conductor at the installation site. In each case, the inner conductor has constructed in accordance with the invention, offers the advantage of a light configuration and ease of handling during installation of an electrical cable.

The invention is not limited to the embodiments described above but all changes and modifications thereof not constituting departures from the spirit and scope of the invention are intended to be included.

I claim:

1. Gas insulated electrical high or ultrahigh voltage cable for transmitting high currents and including a current conducting, inner conductor and an outer tube spaced from the inner conductor in coaxial relation, the improvement comprising:

the inner conductor including a core of alkali-metal, an alloy thereof or two or more alkali-metals, being arranged within an adjoining protective cover made of thermoplastic or elastomeric material, said inner conductor further including a metal envelope enclosing the cover and being comprised of a corrugated metal tube.

2. Cable in accordance with claim 1, wherein the metal tube is comprised of a longitudinally paid metal strip formed into a tube, welded at the endges, and subsequently corrugated, the strip being preferably comprised of copper or an alloy.

3. Cable in accordance with claim 1, wherein the cover sits tightly on the core, but the metal tube sits only loosely on the cover.

4. Cable as in claim 3, wherein the space between the cover and the envelope is filled with an inert gas.

5. Cable as in claim 1, wherein the protective cover contains additives increasing the thermal conductivity and/or the electrical conductivity.

6. Cable as in claim 1, wherein the protective cover as insulating the inner conductor is covered with an additional, conductive layer serving as an outer shield.

7. Cable as in claim 1, wherein the corrugation valleys of the corrugated tube sit on the insulating or conductive layer underneath.

* * * * *